US008096833B2

(12) United States Patent
Tobey

(10) Patent No.: US 8,096,833 B2
(45) Date of Patent: Jan. 17, 2012

(54) PLUG ASSEMBLY

(75) Inventor: Shawn Phillip Tobey, Trinity, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/688,236

(22) Filed: Jan. 15, 2010

(65) Prior Publication Data

US 2011/0177716 A1 Jul. 21, 2011

(51) Int. Cl.
*H01R 13/648* (2006.01)

(52) U.S. Cl. ..... 439/607.23; 439/540.1

(58) Field of Classification Search ..... 439/49, 439/409, 410, 540.1, 607.23–607.25
See application file for complete search history.

(56) References Cited

U.S. PATENT DOCUMENTS

| | | | |
|---|---|---|---|
| 5,639,261 | A | 6/1997 | Rutkowski et al. |
| 5,647,765 | A | 7/1997 | Haas et al. |
| 5,735,712 | A | 4/1998 | Haas et al. |
| 5,895,292 | A | 4/1999 | Affeltranger |
| 6,066,001 | A | 5/2000 | Liptak et al. |
| 6,074,251 | A | 6/2000 | Edgerly et al. |
| 6,227,911 | B1 | 5/2001 | Boutros et al. |
| 6,269,008 | B1 | 7/2001 | Hsu |
| 6,287,149 | B1 | 9/2001 | Elkhatib et al. |
| 6,540,564 | B1 | 4/2003 | Ko |
| 6,655,988 | B1 | 12/2003 | Simmons et al. |
| 6,780,035 | B2 | 8/2004 | Bohbot |
| 6,802,735 | B2 | 10/2004 | Pepe et al. |
| 6,976,867 | B2 | 12/2005 | Navarro et al. |
| 7,033,210 | B1 | 4/2006 | Laurer et al. |
| 7,077,707 | B2 | 7/2006 | Hyland et al. |
| 7,357,675 | B2 | 4/2008 | Barringer et al. |
| 2002/0028604 | A1 | 3/2002 | Lo et al. |
| 2004/0229501 | A1 | 11/2004 | Caveney et al. |
| 2004/0246693 | A1 | 12/2004 | Lloyd et al. |
| 2005/0136747 | A1 | 6/2005 | Caveney et al. |
| 2005/0164548 | A1 | 7/2005 | Spears et al. |
| 2005/0282432 | A1 | 12/2005 | Murr et al. |
| 2009/0142968 | A1 | 6/2009 | Goodrich et al. |

FOREIGN PATENT DOCUMENTS

| | | | |
|---|---|---|---|
| EP | 0 809 331 | A1 | 11/1997 |
| EP | 1 538 715 | A2 | 6/2005 |
| WO | WO 00/44070 | | 7/2000 |

OTHER PUBLICATIONS

Annex to Form PCT/ISA/206 for International Application No. PCT/US2011/000040, International Filing Date Oct. 1, 2011.

*Primary Examiner* — Khiem Nguyen

(57) ABSTRACT

A plug assembly includes a shielded housing having an upper shell, a lower shell and a center plate held between the upper and lower shells. The upper shell has at least one upper plug chamber, and the lower shell has at least one lower plug chamber. The center plate is positioned between, and provides shielding between, the upper and lower plug chambers. A plurality of plugs are received in corresponding plug chambers. Each of the plurality of plugs have a plug insert with shield members defining plug quadrants, and each of the plurality of plugs have a plurality of terminals held by the plug insert. The plurality of terminals are arranged in pairs in each of the plug quadrants.

20 Claims, 7 Drawing Sheets

PLUG ASSEMBLY

BACKGROUND OF THE INVENTION

The subject matter herein relates generally to data communication systems, and more particularly, to plug assemblies for data communication systems.

Data communication systems have many applications, including telecommunications and interconnecting computers over local area networks. Application demands are driving systems to have increased electrical performance while increasing the density of connectivity. Some known systems strive to maximize the number of contact pairs within a connector to make installation orderly and efficient. However, such systems are not without disadvantages. For instance, with increased numbers of contact pairs, and as products become denser, known systems and connectors are challenged to perform wire termination and assemble the connectors. Difficulties arise in achieving desired electrical transmission performance due to interference and signal degradation, such as from cross-talk between contact pairs. While some systems attempt to provide electrical isolation between components by surrounding them with materials that effectively provide shielding from cross-talk, providing such shielding in a limited space while maintaining an acceptable termination and assembly process has proven problematic.

A need remains for a communication system that achieves high transfer rates with desirable system performance and space utilization.

BRIEF DESCRIPTION OF THE INVENTION

In one embodiment, a plug assembly is provided including a shielded housing having an upper shell, a lower shell and a center plate held between the upper and lower shells. The upper shell has at least one upper plug chamber, and the lower shell has at least one lower plug chamber. The center plate is positioned between, and provides shielding between, the upper and lower plug chambers. A plurality of plugs are received in corresponding plug chambers. Each of the plurality of plugs have a plug insert with shield members defining plug quadrants, and each of the plurality of plugs have a plurality of terminals held by the plug insert. The plurality of terminals are arranged in pairs in each of the plug quadrants.

In another embodiment, a plug assembly is provided that includes a plug insert having a front and a rear and shield members defining quadrants extending between the front and the rear. A plurality of terminals are held by the plug insert, and are arranged in pairs in each of the quadrants. A wire organizer is coupled to the rear of the plug insert. The wire organizer has a main body with an upper lacing block and a lower lacing block each formed integrally with the main body. The upper and lower lacing blocks are attached to the main body by living hinges.

In a further embodiment, a plug assembly is provided including a shielded housing having plug chambers arranged in quadrants. The shielded housing has interior shield walls and exterior shield walls surrounding the periphery of the plug chambers. A plurality of plugs are received in corresponding plug chambers, and each of the plurality of plugs have a plug insert with shield members defining plug quadrants. Each of the plurality of plugs have a plurality of terminals held by the plug insert, where the plurality of terminals are arranged in pairs in each of the plug quadrants.

DETAILED DESCRIPTION OF THE INVENTION

Figure 1:
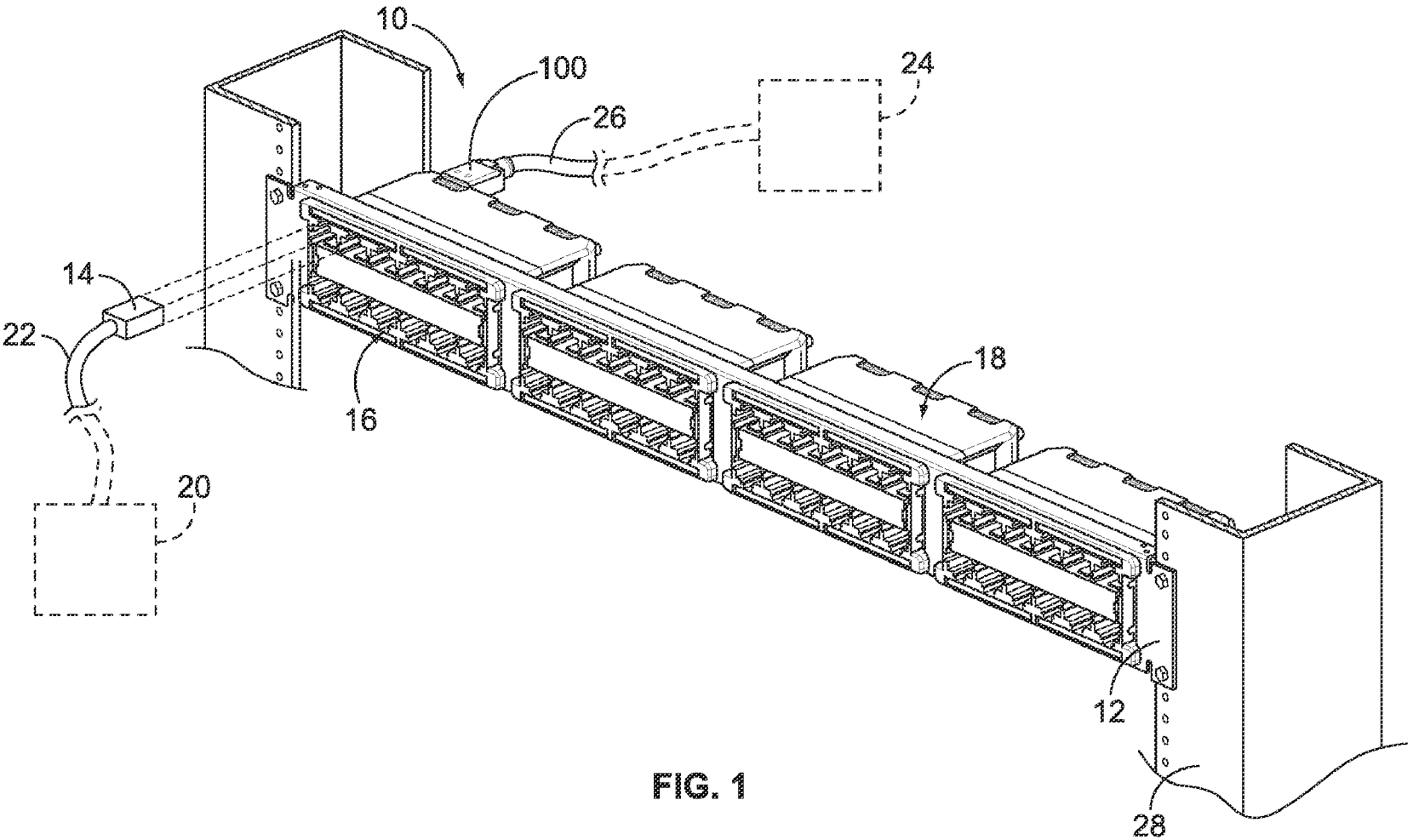
FIG. 1 is a front perspective view of a portion of a cable interconnect system illustrating a panel and a plurality of cassettes mounted to the panel.

FIG. 1 is a front perspective view of a portion of a cable interconnect system 10 illustrating a panel 12 and a plurality of cassettes 18 mounted to the panel 12. FIG. 1 also illustrates a modular plug 14 connected to one of the cassettes 18. The cassette 18 comprises an array of receptacles 16 for accepting or receiving the modular plug 14.

The cable interconnect system 10 is utilized to interconnect various equipment, components and/or devices to one another. FIG. 1 schematically illustrates a first device 20 connected to the cassette 18 via a cable 22. The modular plug 14 is attached to the end of the cable 22. FIG. 1 also illustrates a second device 24 connected to the cassette 18 via a cable 26, such as a multi-pair cable having multiple wire pairs. A plug assembly 100 is provided at the end of each cable 26, which is connected to a back end of the cassette 18. Optionally, a latch assembly 200 may be used to secure the plug assembly 100 to the cassette 18, such as the latch assembly described in copending U.S. patent application Ser. No. 12/688,284, the complete subject matter of which is incorporated by reference in its entirety.

The cassette 18 interconnects the first and second devices 20, 24. In an exemplary embodiment, the first device 20 may be a computer located remote from the cassette 18. The second device 24 may be a network switch. The second device 24 may be located in the vicinity of the cassette 18, such as in the same equipment room, or alternatively, may be located remote from the cassette 18. The cable interconnect system 10 may include a support structure 28, a portion of which is illustrated in FIG. 1, for supporting the panel 12 and the cassettes 18. For example, the support structure 28 may be an equipment rack of a network system. The panel 12 may be a patch panel that is mounted to the equipment rack. In a typical system, multiple panels 12 may be stacked within the support structure 28. The panels 12 may be sized to fit a standard rack specification, such as that defined in EIA-310. For example, the panels 12 may have a one rack unit height, or 1 U height, of 1.75 inches. In alternative embodiments, rather than a patch panel, the panel 12 may be another type of network component used with a network system that supports cassettes 18 and/or other connector assemblies, such as interface modules, stacked jacks, or other individual modular jacks. For example, the panel 12 may be a wall or other structural element of a component. It is noted that the cable interconnect system 10 illustrated in FIG. 1 is merely illustrative of an exemplary system/component for interconnecting communication cables using jacks and plugs or other types of connectors. Optionally, the second device 24 may be mounted to the support structure 28.

Figure 2:
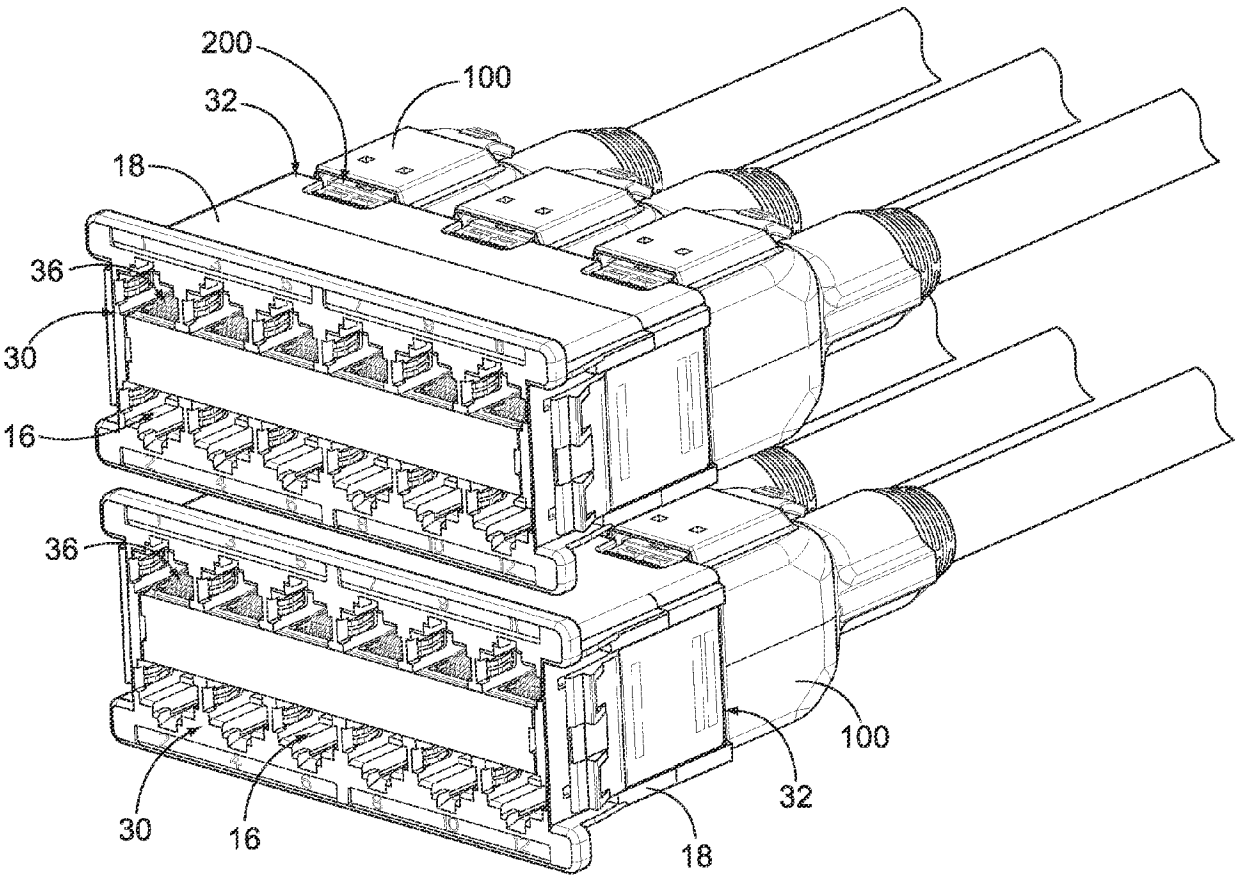
FIG. 2 is a front perspective view of a plurality of stacked cassettes with the corresponding panels removed illustrating a plurality of plug assemblies mated with the cassettes.

FIG. 2 is a front perspective view of a plurality of stacked cassettes 18 with the corresponding panels 12 (shown in FIG. 1) removed illustrating a plurality of plug assemblies 100 mated with the cassettes 18. The cassettes may be substantially similar to the cassettes described in U.S. Pat. No. 7,878,824, the complete subject matter of which is hereby incorporated by reference in its entirety.

The cassette 18 includes a front mating interface 30 and a rear mating interface 32. The modular plugs 14 (shown in FIG. 1) are mated with the cassettes 18 at the front mating interface 30. The plug assemblies 100 are mated with the cassettes 18 at the rear mating interface 32. The cassette 18 includes a plurality of the receptacles 16 open at the front mating interface 30 for receiving the modular plugs 14. In an exemplary embodiment, the receptacles 16 are arranged in a stacked configuration in a first row and a second row. A plurality of receptacles 16 are arranged in each of the first and second rows. In the illustrated embodiment, six receptacles 16 are arranged in each of the first and second rows, thus providing a total of twelve receptacles 16 in each cassette 18. It is realized that the cassettes 18 may have more or less than twelve receptacles 16 arranged in more or less than two rows.

Communication modules 36 are held within the cassette 18 for interfacing with the modular plugs 14 and the plug assemblies 100. The communication modules 36 are exposed within the receptacles 16 for mating with the modular plugs. The communication modules 36 also extend to the rear mating interface 32 for interfacing with the plug assemblies 100. Data is transferred by the communication modules 36 between the modular plugs 14 and the corresponding plug assemblies 100. Optionally, each plug assembly 100 may be electrically connected to more than one communication module 36. For example, each plug assembly 100 is electrically connected to four communication modules 36, and thus communicate with four different modular plugs 14. In the illustrated embodiment, the communication modules 36 are configured to mate with an 8 position, 8 contact (8P8C) type of plug, such as an RJ-45 plug or another copper-based modular plug type of connector at the front mating interface 30. Alternatively, the communication modules 36 may be configured to mate with different types of plugs, such as other copper based types of plugs (e.g. a quad-plug) or fiber-optic types of plugs. The communication modules 36 are configured to mate with a different type of plug at the rear mating interface 32, however the mating interfaces at the front and rear of the communication modules 36 may be the same in some alternative embodiments.

Figure 3:
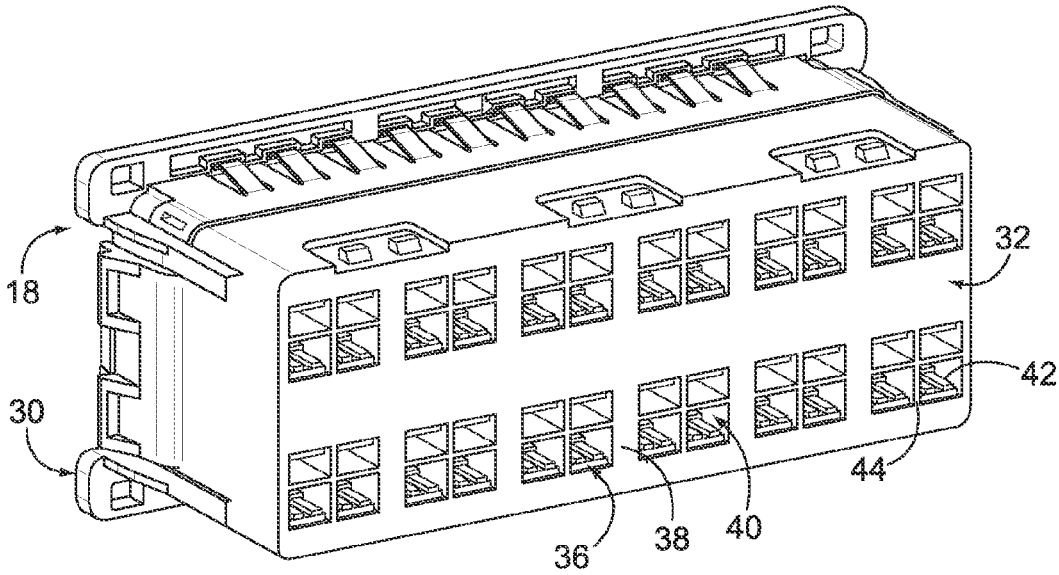
FIG. 3 is a rear perspective view of one of the cassettes.

FIG. 3 is a rear perspective view of one of the cassettes 18 illustrating the rear mating interface 32 and portions of the communication modules 36 at the rear mating interface 32. The communication modules are shown more fully in FIG. 4. The communication modules 36 are configured to be directly electrically connected to the plug assemblies 100 (shown in FIGS. 1 and 2). The cassette 18 includes a plurality of interior walls 38 that define different plug cavities 40 at the rear mating interface 32. The interior walls 38 define shield elements between adjacent plug cavities 40 that provide shielding between the communication modules 36 received in the corresponding plug cavities 40. The walls 38 may extend at least partially between the front and the rear of the cassette 18 and the walls 38 may also define the receptacles 16 (shown in FIG. 2) at the front mating interface 30.

In the illustrated embodiment, the communication modules 36 at the rear mating interface 32 represent a quad-type mating interface configured to receive a quad-type plug connector therein. The communication modules 36 each include contacts 42. The contacts 42 are arranged in pairs in different quadrants of the plug cavities 40. Wall segments 44 divide the plug cavities 40 into quadrants, with each quadrant receiving a pair of the contacts 42. Optionally, the wall segments 44 may provide shielding from adjacent quadrants.

Figure 4:
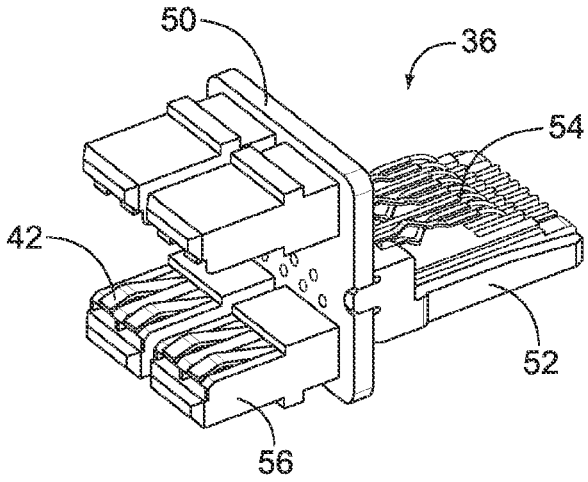
FIG. 4 illustrates an exemplary communication module for use with the cassette shown in FIGS. 1-3.

FIG. 4 illustrates the communication module 36. The communication module 36 includes a circuit board 50, a contact support 52, and a plurality of contacts 54 arranged as a contact set. The contact support 52 and the contacts 54 extend from a front side of the circuit board 50. In the illustrated embodiment, the contact support 52 and the contacts 54 define a mating interface configured to mate with an RJ-45 type plug.

The communication module 36 includes a plurality of support towers 56 mounted to, and extending from, a rear side of the circuit board 50. The support towers 56 hold the contacts 42. Each of the contacts 42 are electrically connected to corresponding ones of the contacts 54 via the circuit board 50. The arrangement of the contacts 42 is different from the contacts 54. For example, the contacts 54 are arranged in a single row, whereas the contacts 42 are arranged in pairs in quadrants. The communication module 36, including the circuit board 50, is received within a corresponding shielded channel of the cassette 18 (shown in FIG. 3). The communication module 36 is isolated from other communication modules 36 by the shielded channels. For example, the interior wall segments 44 (shown in FIG. 3) separate adjacent communication modules 36 from one another.

Figure 5:
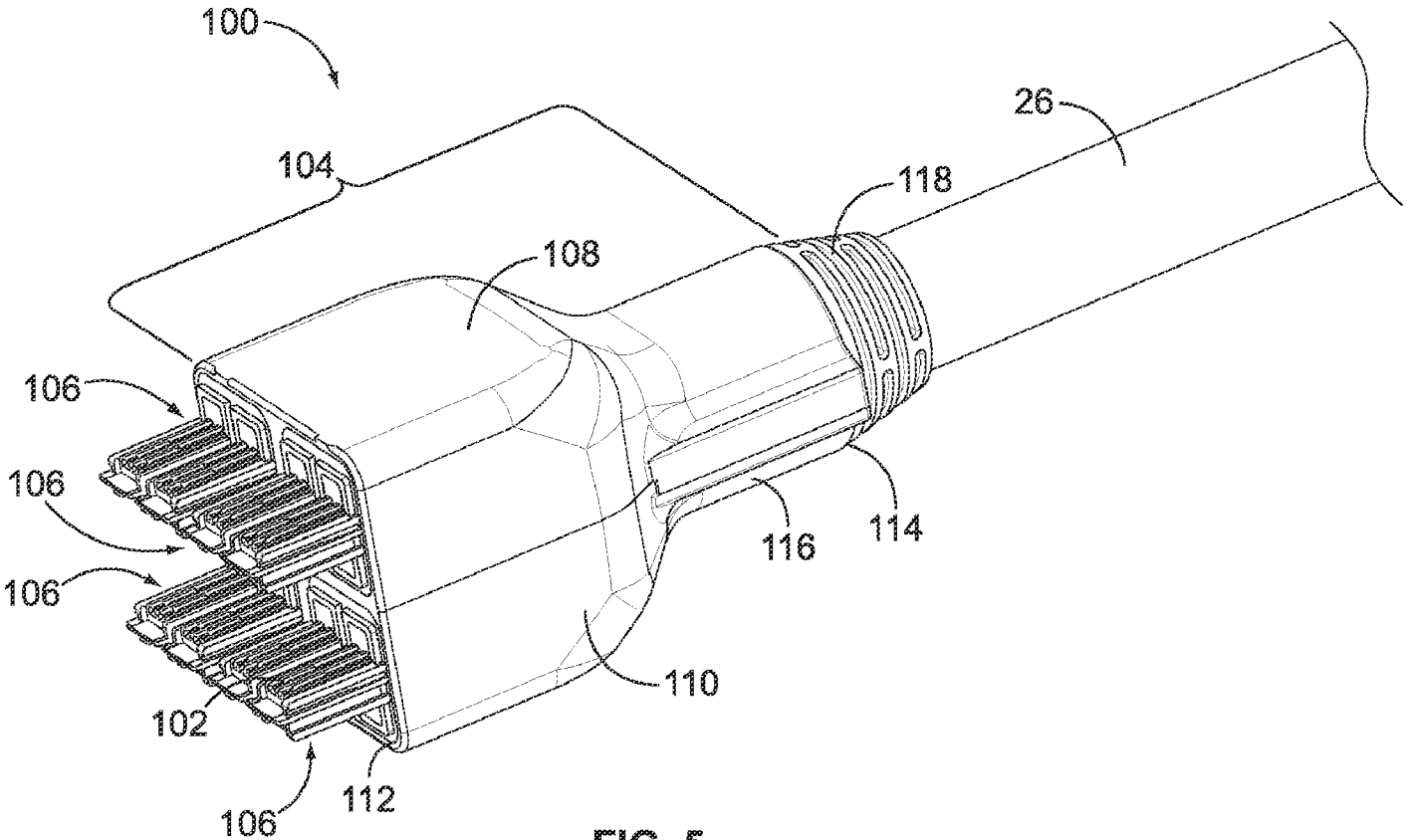
FIG. 5 is a front perspective view of an exemplary plug assembly for mating with the cassette shown in FIGS. 1-3.

FIG. 5 is a front perspective view of the plug assembly 100 for mating with the cassette 18 (shown in FIGS. 1-3). The latch assembly 200 (shown in FIG. 2) has been removed for clarity. The plug assembly 100 is terminated to an end of the cable 26. The cable 26 is a multi-pair cable having multiple wire pairs that are terminated to corresponding terminals 102, which mate with the contacts 42 of the communication module 36 (both shown in FIG. 3). The plug assembly 100 includes a shielded housing 104 which holds a plurality of individual and discrete plugs 106. Each plug 106 is configured to mate with a corresponding communication module 36. As such, when the plug assembly 100 is mated to the cassette 18 (shown in FIGS. 1-3), multiple plugs 106 are simultaneously mated with corresponding communication modules 36.

The shielded housing 104 includes an upper shell 108 and a lower shell 110 coupled together. The shielded housing 104 extends between a mating end 112 and a cable end 114. The cable 26 passes into the shielded housing 104 through a boss 116 at the cable end 114. The boss 116 provides strain relief for the cable 26. Optionally, a ferrule 118 may be provided at the cable end 114 to provide strain relief for the cable 26.

Figure 6:
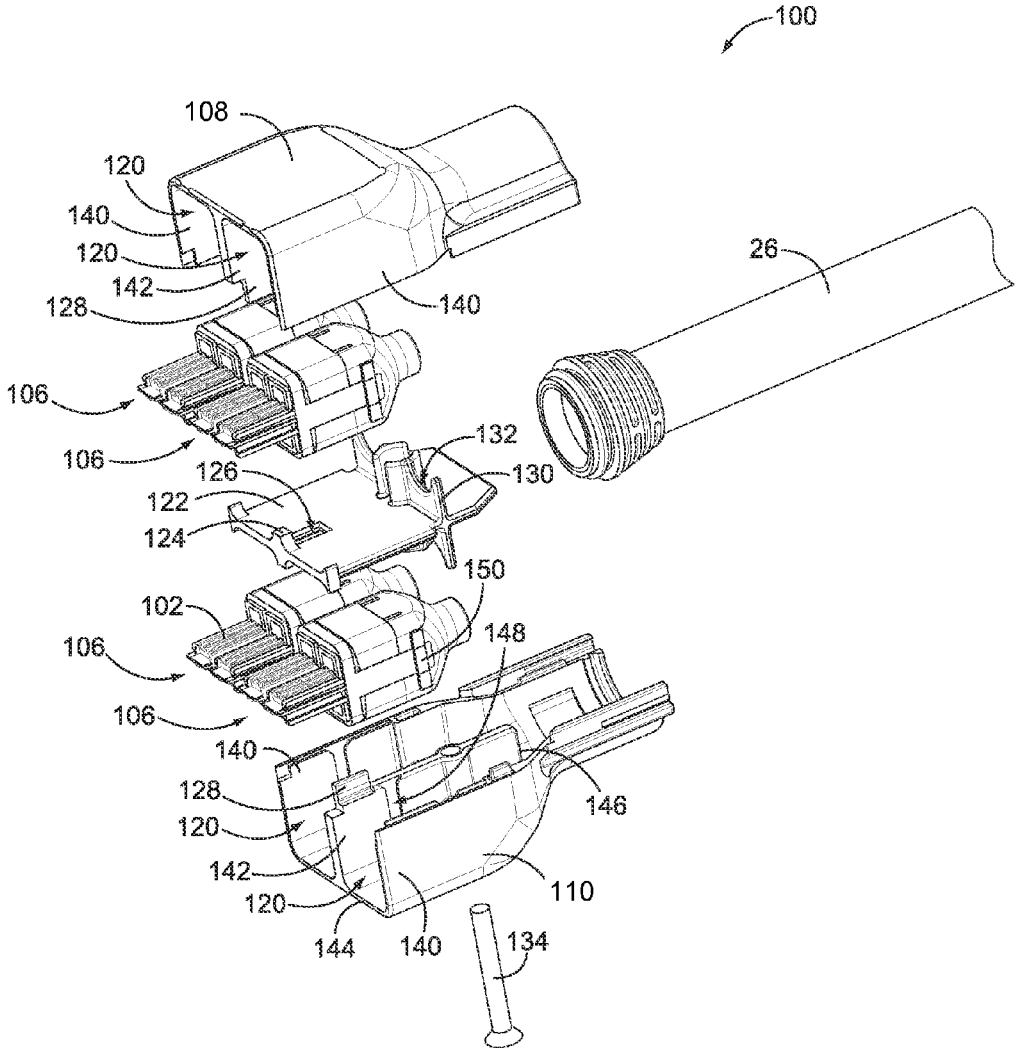
FIG. 6 is an exploded view of the plug assembly shown in FIG. 5.

FIG. 6 is an exploded view of the plug assembly 100 showing the individual plugs 106. The latch assembly 200 (shown in FIG. 2) has been removed for clarity. The plugs 106 are separate from one another and are individually terminated to corresponding wires (not shown) of the cable 26. Optionally, each plug 106 may be terminated to multiple wire pairs extending from the cable 26. For example, in one exemplary embodiment, each plug 106 is terminated to four wire pairs, or eight wires. Once the plugs 106 are terminated to the wires, the plug assembly 100 may be assembled.

During assembly, the plugs 106 are loaded into the shielded housing 104. The shielded housing 104 is fabricated from a metal material, such as an aluminum or aluminum alloy, and thus provides shielding for the plugs 106. In an exemplary embodiment, the plugs 106 are loaded into separate plug chambers 120 that are defined by the shielded housing 104.

As such, the individual plugs 106 are shielded from one another to reduce or prevent cross-talk.

In the illustrated embodiment, the upper shell 108 includes two upper plug chambers 120 and the lower shell 110 includes two lower plug chambers 120. As such, four individual plugs 106 are provided within the plug assembly 100, defining a quad plug assembly 100. However, it is realized that any number of plug chambers 120 may be defined by the upper shell 108 and/or the lower shell 110. Optionally, the upper shell 108 and/or the lower shell 110 may each only have one plug chamber 120. It is also realized that the designation of upper and lower may be different if the plug assembly 100 were rotated 90°, such as to a left/right designation rather than an upper/lower designation.

The shielded housing 104 includes a center plate 122 between the upper and lower shells 108, 110. The center plate 122 is captured between the upper and lower shells 108, 110 when the plug assembly 100 is assembled. The center plate 122 separates the upper and lower plug chambers 120. The center plate 122 is fabricated from a metal material, such as an aluminum or aluminum alloy material, and thus provides shielding for the plug chambers 120. The center plate 122 includes supporting features 124 that support the individual plugs 106 and hold the plugs 106 in the shielded housing 104. The supporting features 124 engage select portions of the plugs 106 to electrically common the shielded housing 104 and the plugs 106. When electrically commoned, the plug 106 and the shielded housing 104 are at the same electrical potential. In the illustrated embodiment, the supporting features 124 constitute protrusions extending from the center plate 122 that interact with the plugs 106 to hold the plugs 106 in place.

In an exemplary embodiment, the center plate 122 includes one or more opening(s) 126 therethrough. Fingers 128 of the upper and lower shells 108, 110 extend into and through the opening 126 to engage one another. The fingers 128 electrically common the upper and lower shells 108, 110 to one another and/or provide mechanical retention for the upper and lower shells 108, 110 to one another or to the center plate 122. When electrically commoned, the upper and lower shells 108, 110 are at the same electrical potential. The fingers 128 may engage the center plate 122 to electrically common the upper and lower shells 108, 110 to the center plate 122. Other portions of the center plate 122 may also engage the upper and lower shells 108, 110 to electrically common the center plate 122 with the upper and lower shells 108, 100. When electrically commoned, the upper and lower shells 108, 110 and the center plate 122 are at the same electrical potential.

The center plate 122 includes flanges 130 that extend both upward and downward therefrom. The flanges 130 are positioned near the back ends of the plugs 106 when the plug assembly 100 is assembled and provide shielding behind the plugs 106. The flanges 130 include cut-outs 132 for the wires and/or the extreme back end of the plugs 106 to pass through. The flanges 130 support the wires and the plugs 106 in position with respect to the center plate 122.

A fastener 134 is used to securely couple the upper and lower shells 108, 110 together, and the fastener 134 extends through the center plate 122. Other types of securing means or features may be used in alternative embodiments, such as latches.

The upper and lower shells 108, 110 may be substantially identical to one another, representing mirrored halves. However, the upper and lower shells 108, 110 may be different from one another in other embodiments. Both shells 108, 110 include exterior shield walls 140. When multiple plug chambers 120 are provided, the shells 108, 110 also include interior shield walls 142 separating adjacent plug chambers 120. The interior shield walls 142 are formed integrally with the exterior shield walls 140. For example, the shells 108, 110 may be die cast to form the exterior and interior shield walls 140, 142. The exterior and interior shield walls 140, 142 extend from a front 144 to a rear 146 of the plug chambers 120 to provide continuous shielding from the front 144 to the rear 146. The interior shield walls 142 provide shielding between adjacent plug chambers 120 in either shell 108, 110. The center plate 122 also defines an interior shield wall that provides shielding between upper plug chambers 120 and lower plug chambers 120. The exterior shield walls 140 include channels 148 the receive protrusions 150 extending from the plugs 106. The channels 148 align the plugs 106 with respect to the shielded housing 104 and hold the plugs 106 in position within the plug chambers 120. In an exemplary embodiment, the channels 148 are offset from one another and the protrusions 150 on opposite sides of each plug 106 are offset from one another. Such offset defines a keying feature for inserting the plugs 106 in the shielded housing 104.

In the illustrated embodiment, the shielded housing 104 includes four plug chambers 120 arranged in quadrants. The interior shield walls 142 and the center plate 122, which also defines an interior shield wall, shield adjacent plug chambers 120 from one another. The exterior shield walls 140 and the interior shield walls 142 surround the periphery of the plug chambers 120. Each plug chamber 120 is bounded on two sides by exterior shield walls 140 and each plug chamber 120 is bounded on two sides by interior shield walls 142. Four plugs 106 are received in the four plug chambers 120. The plug assembly 100 thus defines a quad plug assembly 100. The cable 26 has wires that are terminated to each of the plugs 106 in the different quadrants of the shielded housing 104. As such, the plug assembly 100 includes a single cable 26 with four discrete plugs 106 arranged in quadrants. Additionally, as described in further detail below, each of the plugs 106 represents a quad-type plug having the individual terminals 102 arranged as pairs in quadrants of the plug 106.

Figure 7:
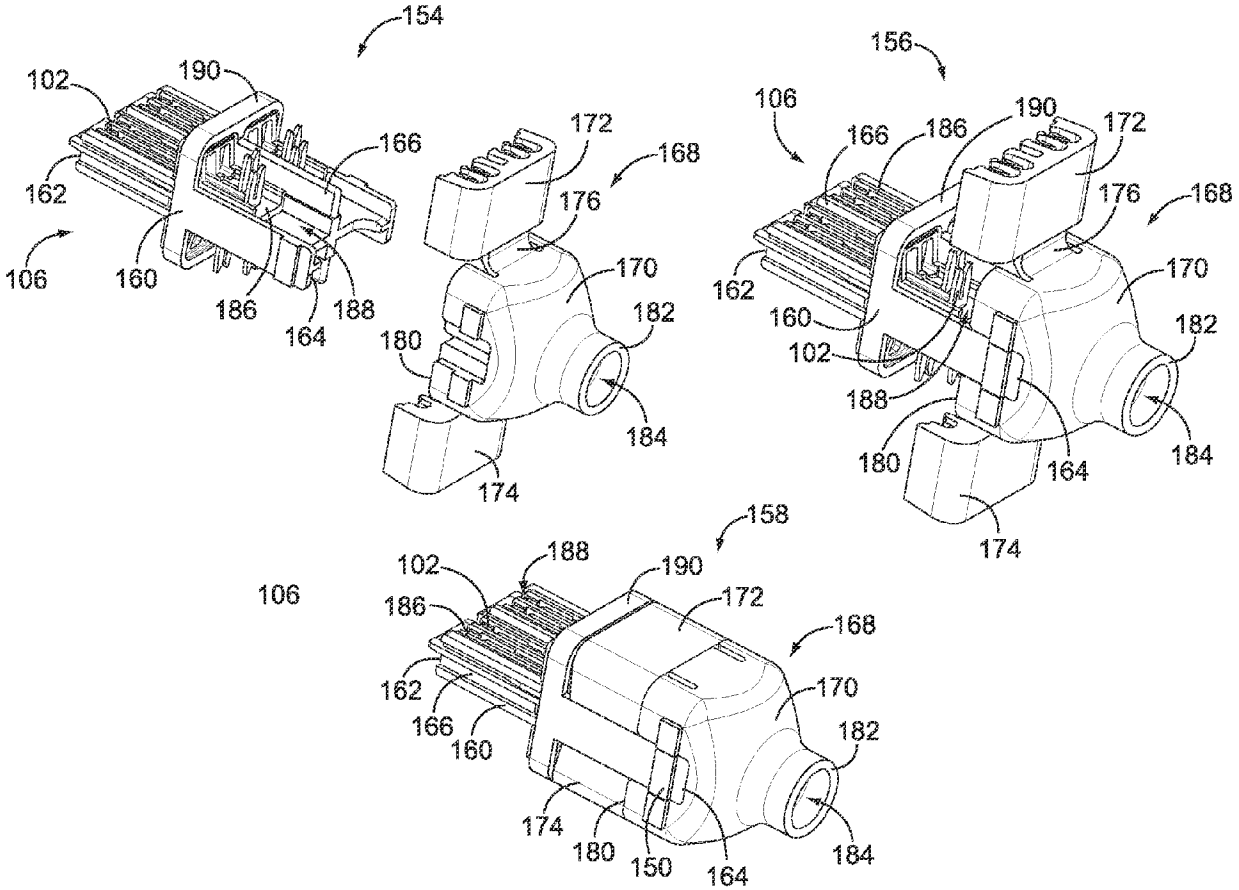
FIG. 7 illustrates various stages of assembly of an exemplary plug for the plug assembly shown in FIG. 6.

FIG. 7 illustrates various stages of assembly of an exemplary plug 106 for the plug assembly 100 shown in FIG. 6. FIG. 7 shows the plug 106 in a dis-assembled state 154, a partially assembled state 156 and an assembled state 158.

The plug 106 includes a plug insert 160 having a front 162 and a rear 164. The plug insert 160 has shield members 166 defining quadrants extending between the front 162 and the rear 164. A plurality of terminals 102 are held by the plug insert 160 and arranged in pairs in each of the quadrants. A wire organizer 168 is coupled to the rear 164 of the plug insert 160.

The wire organizer 168 receives the wires (not shown) from the cable 26 (shown in FIG. 1) and properly positions the wires for connection to the terminals 102. The wire organizer 168 has a main body 170 with an upper lacing block 172 and a lower lacing block 174 each formed integrally with the main body 170. The upper and lower lacing blocks 172, 174 are attached to the main body 170 by living hinges 176, 178 (shown in FIG. 8), respectively. In an exemplary embodiment, the main body 170, upper and lower lacing blocks 172, 174 and the living hinges 176, 178 are a single piece formed during a molding process. As such, the wire organizer 168 may be attached to the plug insert 160 as a single piece. No additional assembly steps are required to connect the lacing blocks 172, 174 to the main body 170. In an exemplary embodiment, the wire organizer 168 is manufactured from a plastic material. As such, the wire organizer is non-conductive. The wire organizer 168 is able to hold the wires without the need for additional plastic inserts or other elements positioned between the wire organizer and the wires.

The main body 170 is funnel shaped from a wide end 180 at a front of the main body 170 to a narrow end 182 at a rear of the main body 170. The main body 170 includes a cable opening 184 at the narrow end 182. The cable opening 184 receives wires of the cable 26 therethrough. The wide end 180 is configured for mounting to the rear 164 of the plug insert 160.

The plug insert 160 is provided to hold the terminals 102. In an exemplary embodiment, the plug insert 160 is fabricated from a metal material, such as aluminum or an aluminum alloy, and thus provides shielding between the various pairs of terminals 102 arranged in the different quadrants. The plug insert 160 and the terminals 102 are arranged to define a quad-type plug, having the terminals 102 arranged in pairs in different quadrants. Each quadrant is shielded from adjacent quadrants by the shield members 166. The pairs of terminals 102 convey differential signals, and thus define differential pairs. The terminals 102 are generally linear and do not cross over one another. Such an arrangement, with the shielding between, provides an interface that may have better performance characteristics than other types of connectors, such as an RJ-45 type interface. As such, high speed data signals can be effectively transferred across the interface.

The terminals 102 are held in terminal housings 186, which are dielectric housings that hold a pair of terminals. The terminal housings 186 are loaded into corresponding slots 188 defined by the shield members 166. For example, vertical shield members 166 define two columns of slots 188 and horizontal shield members 166 define two rows of slots 188. The terminal housings 186 provide isolation from the plug insert 160 such that the terminals 102 do not directly contact the plug insert 160. The vertical shield members 166 are of a height sufficient to cover a vertical height of the terminals 102 for the entire length of the terminals 102. Similarly, the horizontal shield members 166 are of a width sufficient to cover a horizontal width of the terminals 102 for the entire length of the terminals 102.

In an exemplary embodiment, the plug insert 160 includes a flange 190 approximately centrally located along the plug insert 160 between the front and rear 162, 164. The flange 190 helps hold the terminal housings 186 in the slots 188. The flange 190 defines an outer perimeter of the plug insert 160 when the plug 106 is in the assembled state that is exposed. When assembled into the plug assembly 100 (shown in FIG. 6), the flange 190 provides shielding and engages the shielded housing 104 (shown in FIG. 6) to electrically common the plug 106 with the shielded housing 104. When electrically commoned, the plug 106 and the shielded housing 104 are at the same electrical potential.

When the plug assembly 100 is assembled, the plug insert 160 and the wire organizer 168 cooperate to form the 150 on both sides thereof. For example, protrusion segments are provided on both the main body 170 and the plug insert 160. The protrusion segments are aligned when fully assembled to define the protrusion 150. When the protrusion 150 is received in the channel 148 (shown in FIG. 6), the channel 148 helps hold the plug assembly together. For example, when the protrusion segments are in the channel 148, the protrusion segments cannot move relative to one another (e.g. forward or backward). As a result, the interaction between the channel 148 and the protrusion 150 locks the plug insert 160 in position with respect to the wire organizer 168.

Figure 8:
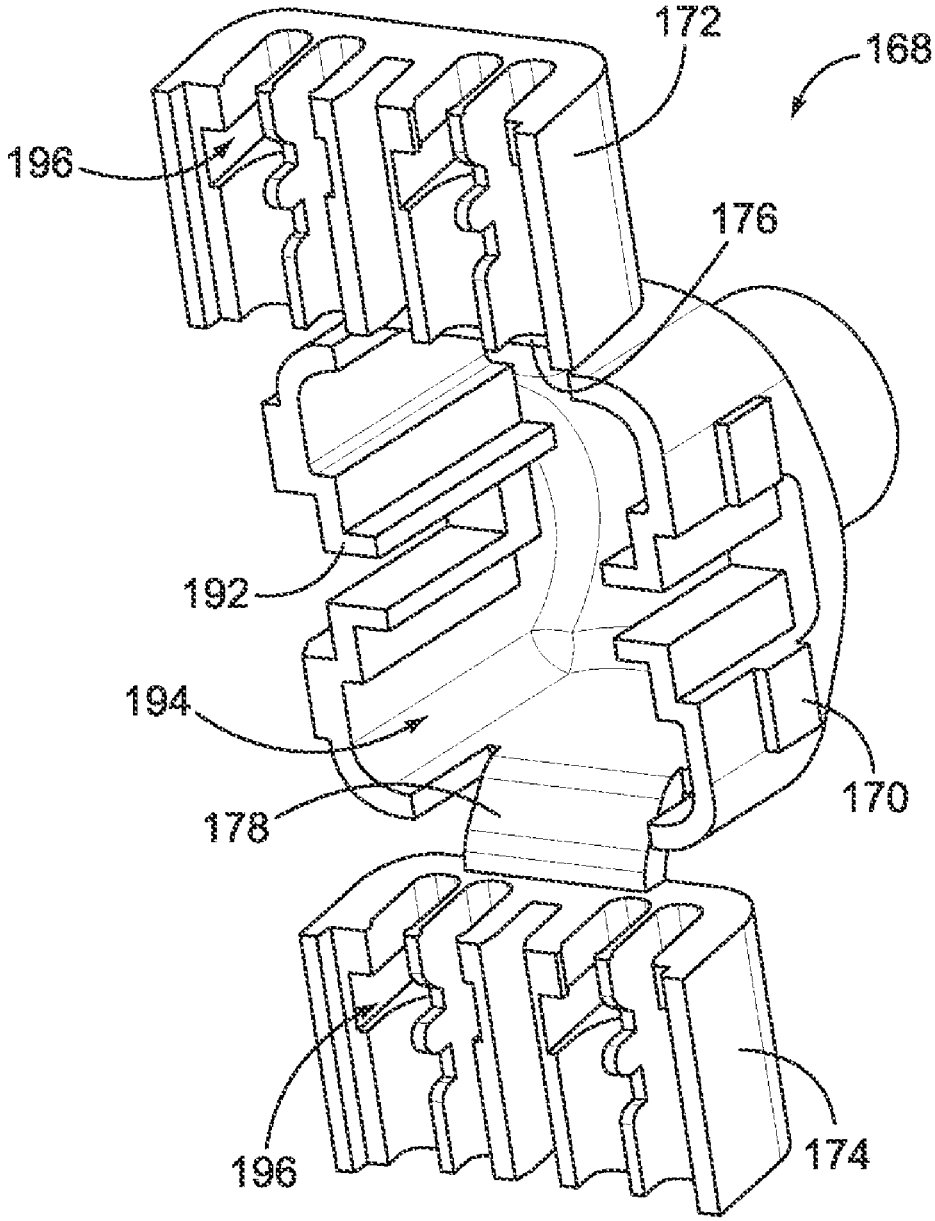
FIG. 8 is a front perspective view of a wire organizer for the plug shown in FIG. 7.

FIG. 8 is a front perspective view of the wire organizer 168. The main body 170 includes mounting features 192 that are configured to engage the plug insert 160 (shown in FIG. 7) to securely couple the wire organizer 168 to the plug insert 160. The mounting features 192 may engage portions of the plug insert 160 by an interference fit to securely retain the wire organizer 168 in position.

The main body 170 includes a wire receiving chamber 194 configured to receive the wires therein through the cable opening 184. The wire receiving chamber 194 is completely surrounded by the main body 170 and is open at a front of the main body 170 for receiving a portion of the plug insert 160. The wire receiving chamber 194 defines a space through which the individual wire pairs and wires are routed to the upper and lower lacing blocks 172, 174.

The upper and lower lacing blocks 172, 174 are flexibly coupled to the main body 170 by the living hinges 176, 178. The living hinges 176, 178 are thin portions of the wire organizer 168 that are integral with the main body 170. The living hinges 176, 178 allow the lacing blocks 172, 174 to move relative to the main body 170 between an open position and a closed position. For example, the lacing blocks 172, 174 may be pivoted open and closed. The lacing blocks 172, 174 have wire receiving channels 196 configured to hold individual wires therein. The wire receiving channels 196 are shaped to hold the wires therein, and the wires may be moved with the lacing blocks 172, 174.

Returning to FIG. 7, during assembly of the plug 106, the wires are passed through the cable opening 184 into the wire receiving chamber 194. The wires may be pulled through the front of the main body 170. With the lacing blocks 172, 174 in open positions (e.g. flared outward away from each other), the wires are laced into the corresponding lacing blocks 172, 174. The wire organizer 168 is then coupled to the plug insert 160, as shown in the partially assembled state 156. The lacing blocks 172, 174 are then pivoted about the living hinges 176, 178 to the closed positions, such as shown in the assembled state 158. As the lacing blocks 172, 174 are closed, the wires engage the terminals 102. In an exemplary embodiment, the terminals 102 are insulation displacement terminals having insulation displacement portions. The wires are terminated to the terminals 102 when the lacing blocks 172, 174 are closed by pushing the wires onto the insulation displacement portions. Other types of contacts may be used in alternative embodiments, such as pin and socket type contacts, crimped contacts, poke-in wire contacts, and the like.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A plug assembly comprising:

a shielded housing having an upper shell, a lower shell and a center plate held between the upper and lower shells, the upper shell having at least one upper plug chamber, the lower shell having at least one lower plug chamber, the center plate being positioned between, and providing shielding between, the upper and lower plug chambers; and a plurality of plugs received in corresponding plug chambers, each of the plurality of plugs having a plug insert with shield members defining plug quadrants, each of the plurality of plugs having a plurality of terminals held by the plug insert, the plurality of terminals being arranged in pairs in each of the plug quadrants.

2. The plug assembly of claim 1, wherein the plugs each comprise a wire organizer coupled to the plug insert, each wire organizer having a main body with an upper lacing block and a lower lacing block each formed integrally with the corresponding main body, the upper and lower lacing blocks attached to the main body by living hinges.

3. The plug assembly of claim 2, wherein each main body includes a cable opening therethrough configured to receive wires therethrough, the wires being laced into corresponding upper and lower lacing blocks.

4. The plug assembly of claim 2, wherein the upper and lower lacing blocks are pivoted by the living hinges from open positions to closed positions, the upper and lower lacing blocks being configured to terminate individual wires to corresponding terminals when in the closed positions.

5. The plug assembly of claim 1, wherein the upper shell includes multiple upper plug chambers and the lower shell includes multiple lower plug chambers each receiving corresponding plugs.

6. The plug assembly of claim 1, further comprising a multi-pair cable having multiple pairs of wires, the wires being terminated to corresponding terminals of each of the plugs.

7. The plug assembly of claim 1, wherein the center plate includes supporting features engaging the plugs to hold the plug in the corresponding plug chambers, the supporting features directly engaging the plug insert to electrically common the plugs to the shielded housing.

8. The plug assembly of claim 1, wherein the center plate includes an opening, the upper shell and the lower shell having fingers extending into the opening to engage one another, the fingers electrically commoning the upper and lower shells to one another.

9. A plug assembly comprising:

a shielded housing having plug chambers arranged in quadrants, the shielded housing having interior shield walls and exterior shield walls surrounding the periphery of the plug chambers; and a plurality of plugs received in corresponding plug chambers, each of the plurality of plugs comprising:

a plug insert having a front and a rear, the plug insert having shield members defining quadrants extending between the front and the rear;

a plurality of terminals held by the plug insert, the plurality of terminals being arranged in pairs in each of the quadrants; and a wire organizer coupled to the rear of the plug insert, the wire organizer having a main body with an upper lacing block and a lower lacing block each formed integrally with the main body, the upper and lower lacing blocks attached to the main body by living hinges.

10. The plug assembly of claim 9, wherein the main body includes a cable opening therethrough configured to receive wires therethrough.

11. The plug assembly of claim 9, wherein the main body and the upper and lower lacing blocks are a single piece formed during a molding process.

12. The plug assembly of claim 9, wherein the upper and lower lacing blocks are pivoted by the living hinges from open positions to closed positions, the upper and lower lacing blocks being configured to terminate individual wires to corresponding terminals when in the closed positions.

13. The plug assembly of claim 9, wherein the main body includes mounting features, the mounting features engage the plug insert to securely couple the wire organizer to the plug insert.

14. The plug assembly of claim 9, wherein the main body is funnel shaped from a wide end to a narrow end, the main body includes a cable opening at the narrow end, the cable opening being configured to receive wires of a cable therethrough.

15. The plug assembly of claim 9, wherein the upper and lower lacing blocks have wire receiving channels configured to hold individual wires therein, the upper and lower lacing blocks being pivoted closed by the living hinges to terminate the wires to the terminals.

16. The plug assembly of claim 9, wherein the living hinges are formed integrally with corresponding lacing blocks and the main body.

17. The plug assembly of claim 9, wherein the main body includes a wire receiving chamber configured to receive wires therein, the wire receiving chamber being completely surrounded by the main body, the wire receiving chamber being open at a front of the main body for mating with the plug insert.

18. A plug assembly comprising:

a shielded housing having plug chambers arranged in quadrants, the shielded housing having interior shield walls and exterior shield walls surrounding the periphery of the plug chambers; and a plurality of plugs received in corresponding plug chambers, each of the plurality of plugs having a plug insert with shield members defining plug quadrants, each of the plurality of plugs having a plurality of terminals held by the plug insert, the plurality of terminals being arranged in pairs in each of the plug quadrants.

19. The plug assembly of claim 18, wherein each plug chamber is bounded on two sides by interior shield walls and each plug chamber is bounded on two sides by exterior shield walls.

20. The plug assembly of claim 18, wherein the plugs include protrusions extending therefrom and wherein the plug chambers include channels receiving the protrusions, the plugs being held in position within the plug chambers by the interaction between the protrusions and the channels.

* * * * *